United States Patent [19]

Berberich

[11] Patent Number: 5,052,293

[45] Date of Patent: Oct. 1, 1991

[54] INK CONTAINER FOR TAMPON PRINTING PRESSES

[75] Inventor: Bernd Berberich, Schwieberdingen, Fed. Rep. of Germany

[73] Assignee: Tampoflex GmbH, Fed. Rep. of Germany

[21] Appl. No.: 519,449

[22] Filed: May 7, 1990

[30] Foreign Application Priority Data

May 5, 1989 [DE] Fed. Rep. of Germany ..... 3914803

[51] Int. Cl.[5] ..... B41F 1/38; B41F 1/46; B41F 9/10

[52] U.S. Cl. ..... 101/163; 101/321

[58] Field of Search ..... 101/150, 163, 164, 165, 101/167, 169, 157, 363, 350, 366, 126, 41, 44, 292, 287, 316, 318, 320, 321, 324, 326

[56] References Cited

U.S. PATENT DOCUMENTS 4,545,300 10/1985 Jensen ..... 101/126 X 4,615,266 10/1986 DeRoche et al. ..... 101/150

FOREIGN PATENT DOCUMENTS 0012934 2/1982 European Pat. Off. .

0178112 4/1986 European Pat. Off. ..... 101/163

2205430 6/1981 Fed. Rep. of Germany ..... 101/163

3335230 4/1985 Fed. Rep. of Germany ..... 101/163

3506297 7/1987 Fed. Rep. of Germany .

0225347 10/1987 Japan ..... 101/163

*Primary Examiner*—J. Reed Fisher

*Attorney, Agent, or Firm*—Speckman & Pauley

[57] ABSTRACT

This invention relates to an ink container, for example a pot, a tank or the like, for a tampon printing press having a printing block, on which an ink transport element, for example a roller, as well as a doctor blade can be moved back and forth. The ink container is enclosed by a cover element, containing the ink transport element and the doctor blade, which can be moved between operational positions in which it uncovers and covers the printing block.

14 Claims, 4 Drawing Sheets

INK CONTAINER FOR TAMPON PRINTING PRESSES

BACKGROUND OF THE INVENTION

1. Field Of the Invention

This invention relates to an ink container, for example a pot, tank, or the like, for tampon printing presses having a printing block on which an ink transport element, for example a roller, as well as a doctor blade can be moved back and forth.

2. Description of the Prior Art

Ink pots are used to apply ink in conventional tampon printing presses of the type mentioned above. The color pigments present in the ink are heavier than the fixing and solvent means of the ink and thus settle. As a rule, this results in accelerated wear of the doctor blade and in particular of the expensive steel printing block, because the applied ink, which hardly contains any solvent means, dries quickly and the pigments directly contact the doctor blade and damage it.

A further disadvantage is that the quality of the printed image deteriorates over the length of the use of the ink, because a portion of the solvent means evaporates from the ink container. This becomes particularly apparent in connection with small printing and symbols, where accuracy of their detail diminishes because in this situation the proportion of solvent means is reduced too much for resolution.

SUMMARY OF THE INVENTION

Based on the state of the art described above it is an object of this invention to produce an ink container where the quality of the printed image is markedly improved and remains nearly constant in the course of the operation of the tampon printing press.

This object is achieved in accordance with this invention with an ink container enclosed by a cover element, containing the ink transport element and the doctor blade, and being movable between operational positions in which it uncovers and covers the printing block.

In one preferred embodiment according to this invention, the ink container is designed in such a way that it is located in a nearly airtight chamber so that no atmospheric air exchange can take place. This has one advantage that there is almost no evaporation of the solvent means and, also, that oxidation of the ink is minimized. At the same time, the constant back and forth movement of the ink transport element assures constant mixing of the ink. Thus, settling of ink pigments on the bottom of the ink container is hardly possible.

Further practical and advantageous designs of the invention ensue from the dependent claims.

In a particularly practical design, the cover element is a hollow chamber and is fixedly connected with the ink transport element and the doctor blade. During operation, the cover element constantly moves with respect to the printing block or the ink container. In this connection, a number of embodiments are possible.

In one embodiment, the cover element can be fixed in place in relation to the tampon printing press, while the ink container performs the linear back and forth movements. But there also is the possibility of a kinematic reversal.

Finally, it is also possible to design the ink container and the cover element in such a way that they move in relation to the tampon printing press.

In connection with an ink container, the upper surfaces of the ink container as well as those of the printing block are located in approximately the same plane. It is practical, in the uncovering work position of the cover element, if the frame on the open side of the cover element facing the ink container is located approximately in the plane of the upper surface of the ink container. In such embodiment of this invention, it is practical for the frame of the cover element to be in the form of sealing bodies. These steps can also be taken in such a way that the sealing bodies are in pressure contact with the frame of the ink container. The cover element does not only perform back and forth movements, but also tilting movements. During the forward movement, the doctor blade is disposed at a distance from the printing block and during the backward movement it presses down on the printing block and strips off the ink in the direction of the ink container.

When using ink which very quickly and strongly reacts with the ambient air, it is practical to fill the interior of the ink container with a gas which displaces the ambient air and does not react with the ink. Thus, it is particularly practical if the interior of the ink container is connected with a pressure medium line by means of which the space formed between the ink container and the cover element can be filled with gas. Because the space between the cover element and the ink container need not necessarily be airtight, the gas flowing into the interior can escape to the outside. The gases particularly suited for this are known to one skilled in the art.

An exemplary embodiment of the invention is shown schematically in the drawings and will be described in detail below.

DETAILED DESCRIPTION OF PREFERRED EMBODIMENTS

Figure 1:
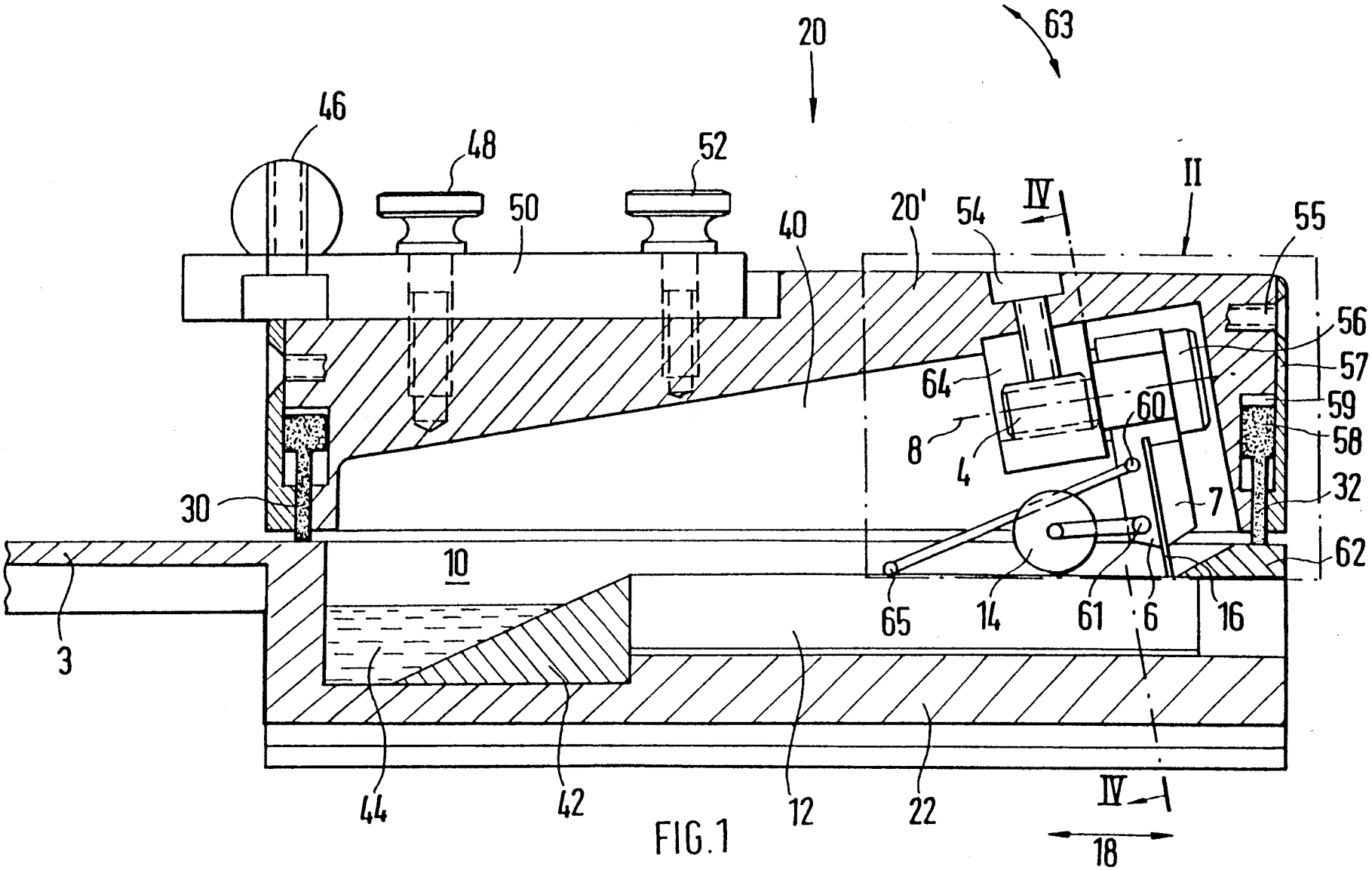
FIG. 1 is a vertical section through a printing block support with a cover element moved out.
Figure 2:
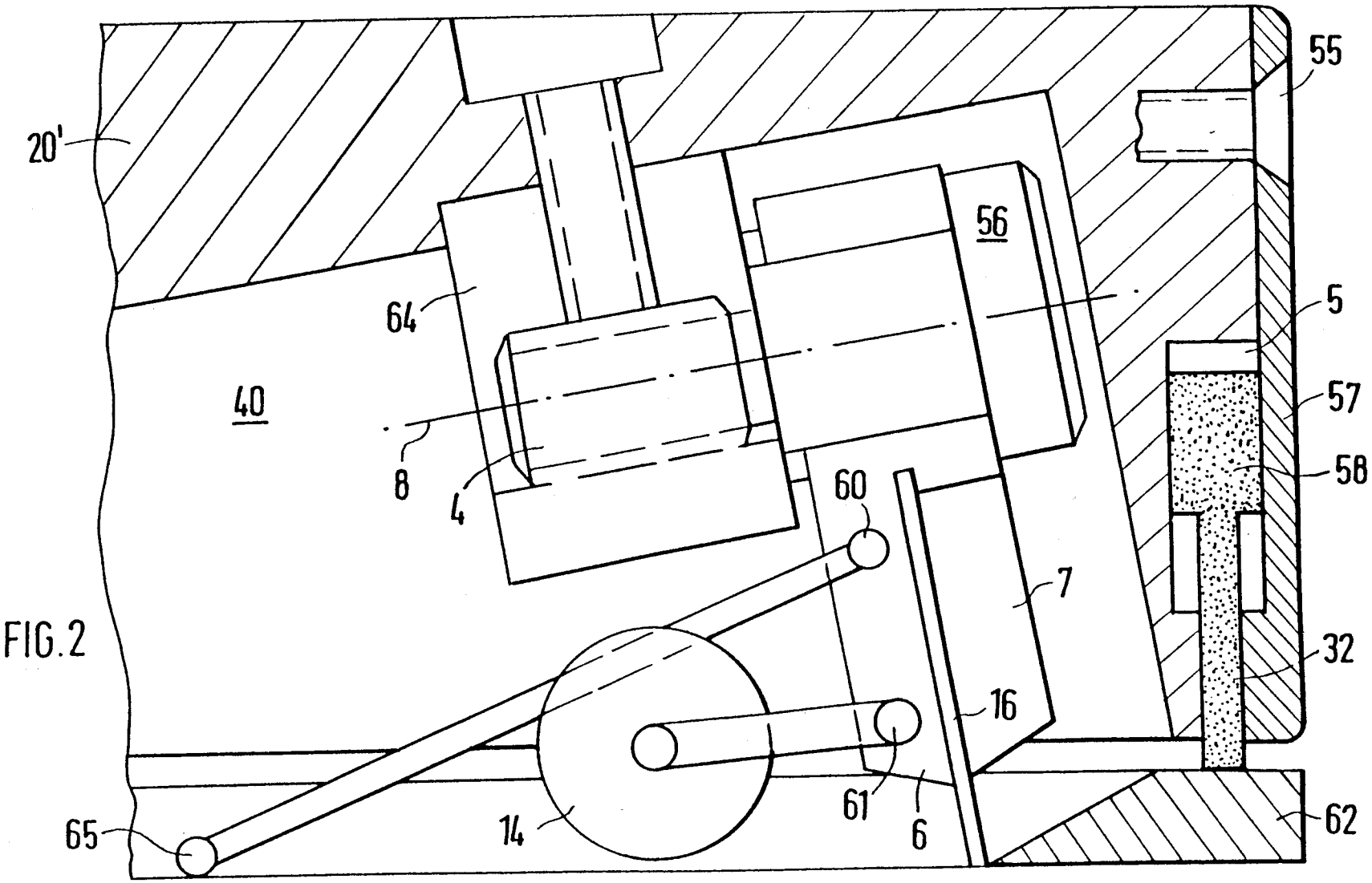
FIG. 2 is an enlargement of the part designated by II in FIG. 1.

A portion of an ink container 10, in this case a tank, for a tampon printing press is shown in FIGS. 1 to 4. The ink container 10 is a part of a printing block holder 22 supporting a printing block 12. A cover element 20 is positioned on the printing block holder 22, which is fixedly connected with the body of the tampon printing press, so that the ink container 10 can perform linear back and forth movements in the direction of the arrow 18. The printing block holder 22 is connected with the tampon printing machine, not shown, by means of an arm 3. A depression, which defines the ink container 10, is located at approximately the center of the printing block holder 22. A wedge-shaped body 42 with ink 44 is positioned in this depression. A body 42 has been provided to improve the rolling of a roller 14 in the ink container 10.

The cover element 20 is generally of cuboid shape and has a wedge-shaped recess 40, which widens in a direction of the doctor blade 16. The cover element 20 is connected with the tampon printing press via an arm 50 and screws 48 and 52. An articulated body 46 permits pivotal movements in the direction of the double arrow 63. The cover element 20 has a bore 54 in its upper surface, which accommodates a screw, not shown. A support body 64 can be connected with the cover element 20 by means of such screw. The support body 64 bears a tang 56, which is pivotally supported in an area 4 around its longitudinal central axis 8. The tang 56 bears a support 6 for a shackle 65, the roller 14 and the doctor blade 16. A solid connection between the doctor blade 16 and the support 6 is provided with a die-formed part 7, which can be connected with the support 6 by means of screws. The roller 14 is not only rotatable about its own axis, but can also pivot around the joint 61. The shackle 65 pivots around the shaft 60. Such pivotal movement can be seen in FIGS. 1 and 3. The cover element 20 is comprised of a basic element 20', in the vertical sides of which are recesses for sealing bodies 30, 32, 34 and 36. Each one of the sealing bodies 30, 32, 34 and 36 has a lip-like section which is in pressure contact with the upper surface of the frame of the printing block support 22. Upper portions 58', 58, 71 and 70 of the sealing bodies 30, 32, 34 and 36 are thickened and shaped in such a way that the sealing bodies 30, 32, 34 and 36 come into pressure contact with the printing block holder 22.

The sealing bodies 30, 32, 34 and 36 are connected with the basic element 20' by means of plates 57, 72 and 73 and screws 55. The plates 72 and 73 are drawn downward so that they laterally extend around the printing block holder 22.

The initial position of the cover element 20 with respect to the printing block holder 22 is shown in FIG. 1. If the tampon printing press is started, the printing block holder 22 moves towards the right in the direction of the double arrow 18 while the doctor blade 16 is guided on the printing block 12.

Figure 3:
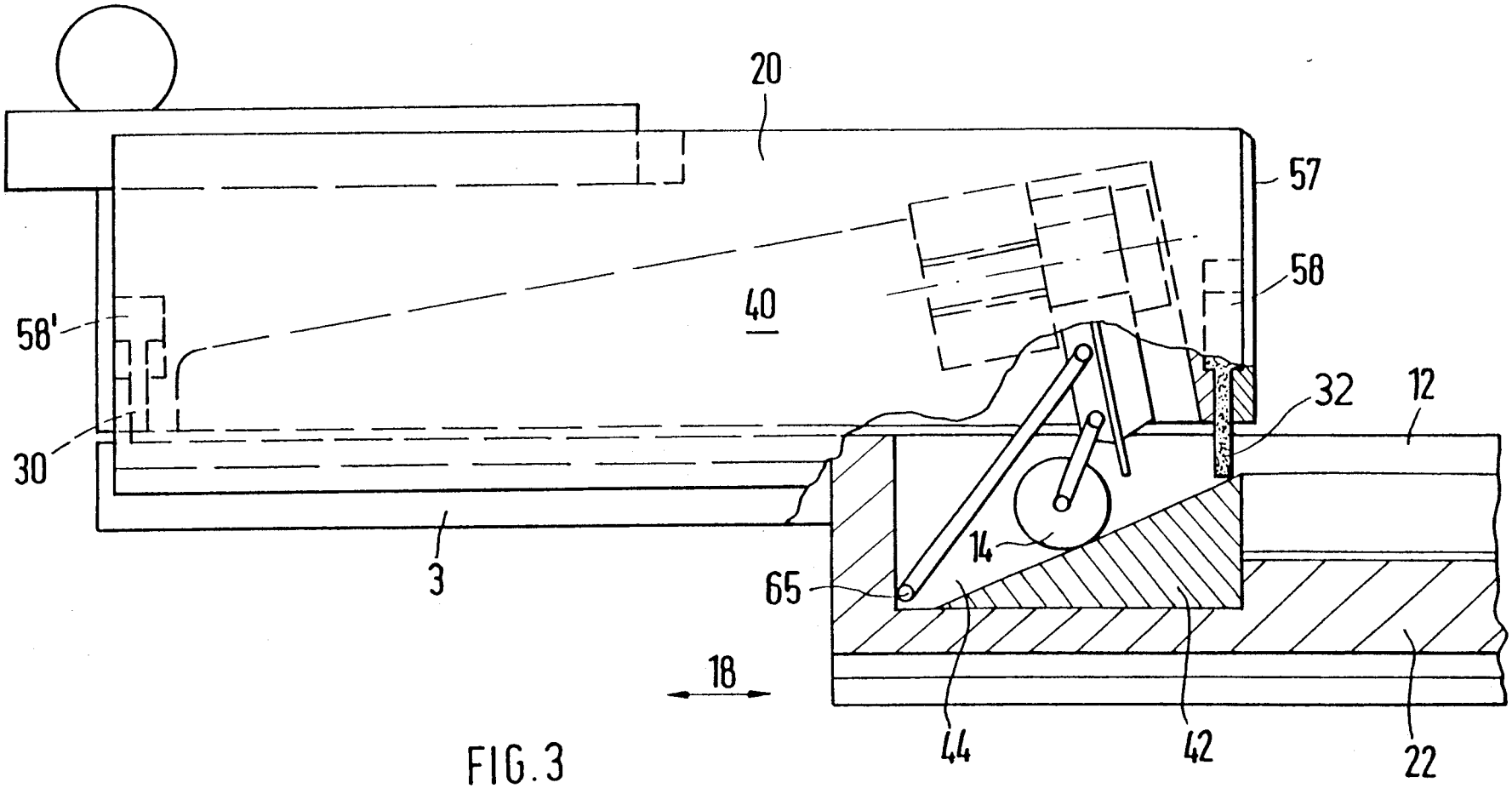
FIG. 3 shows the cover element illustrated in FIG. 1, but in a moved in position rather than a moved out position.
Figure 4:
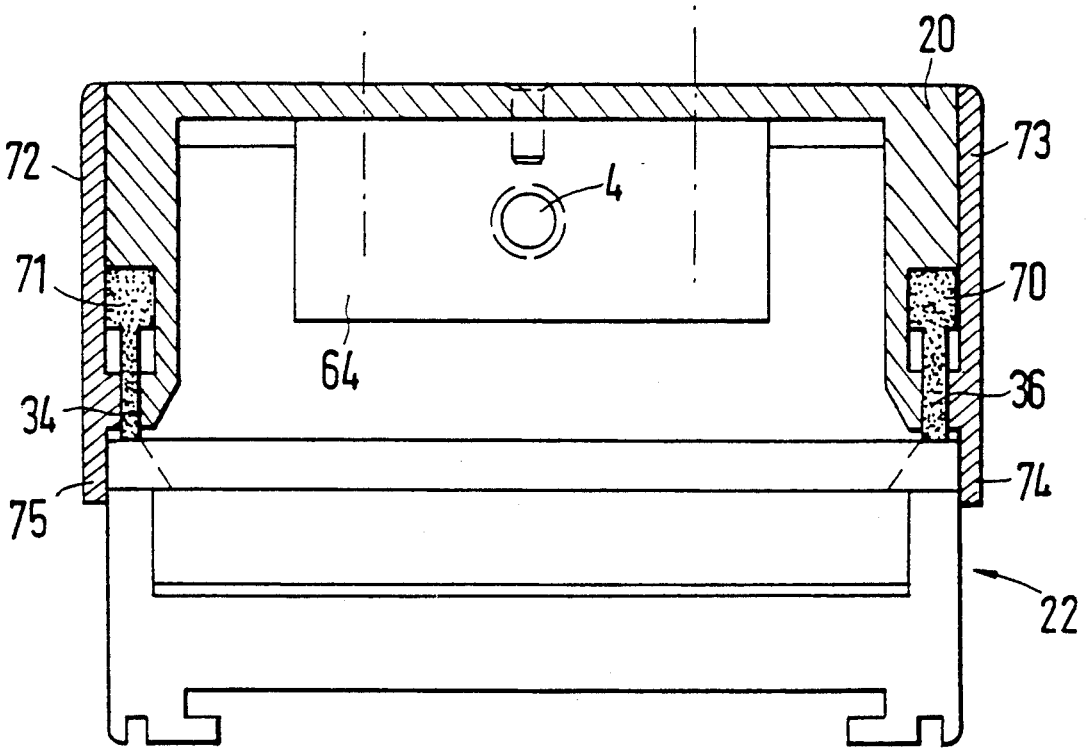
FIG. 4 is a section along the line IV—IV, as shown in FIG. 1.

Once the position illustrated in FIG. 3 has been reached, the shackle 65 is dipped into the ink 44, which is thereby mixed. The roller 14 comes into contact with the ink 44. Subsequently the printing block holder 22 moves to the left, the ink taken up by the roller 14 is deposited on the printing block 12, and the doctor blade 16 is disposed at a distance from the printing block 12 until the position shown in FIG. 1 has been reached. Subsequently the basic element 20' pivots downward in the direction of the double arrow 63, so that the doctor blade 16 comes into pressure contact with the printing block. Following a further movement of the printing block holder 22 towards the right, the excess ink is stripped off the printing block 12 and returned to the tank 10. The printing image on the printing block is removed by a tampon. During the back and forth movement, the interior chamber 40 is closed nearly airtight by means of the elastically deformable sealing lips 30 to 34 providing the actual connection between the cover element 20 and the printing block holder 22.

The advantages achieved by this invention particularly include the fact that the ink contained in the ink container can be used in its entirety and thus during the entire length of operation, without need to additionally thin the ink with a solvent. For this reason there is no dilution of the ink and no idle time because of the need to clean the printing block. The ink container can be easily reached for replenishing the ink by lifting the cover element 20. The printing block 12 can be easily changed in the position of operation (see FIG. 3) without the ink being touched. Conventional printing blocks of steel or plastic can be used.

What is claimed is:

1. An inker for a tampon printing machine comprising:

a printing block holder fixedly connected with the body of said tampon printing machine;

said printing block holder carrying an ink container and a printing block;

a moveable cover element, said cover element supporting an ink transport element and a doctor blade, said cover element enclosing said ink container, said printing block, said ink transport element, and said doctor blade;

said ink transport element further comprising a roller;

means for moving said cover element between a first extreme position in which it covers the printing block and a second extreme position whereby it uncovers the printing block;

means for moving said printing block holder in a linear back and forth direction of movement relative to said cover element and beneath said cover element, said doctor blade and said ink transport, whereby in one direction of movement said ink container engages with said ink transport element for inking said printing block and in another direction of movement said doctor blade engages said printing block for stripping excess ink from the printing block.

2. An inker in accordance with claim 1, wherein said cover element (20) is a hollow body which is fixedly connected with said ink transport element (14) and said doctor blade (16).

3. An inker in accordance with claim 2, wherein upper surfaces of an ink container frame of said ink container (10) and of one of the printing block (12) and said printing block holder (22) are located in approximately a same plane, and in said second extreme position of said cover element (20), a cover element frame on an open side of said cover element (20) facing said ink container (10) is located approximately in said same plane of said upper surfaces of said ink container frame.

4. An inker in accordance with claim 3, wherein said cover element frame of said cover element (20) is formed by sealing bodies (30, 32, 34, 36).

5. An inker in accordance with claim 4, wherein said sealing bodies (30, 32, 34, 36) are in pressure contact with said ink container frame of said ink container (10).

6. An inker in accordance with claim 5, wherein said sealing bodies (30, 32, 34, 36) are of an elastically deformable material.

7. An inker in accordance with claim 6, wherein an interior space (40) of said cover element (20) is filled with a gas which displaces ambient air and does not react with ink in said ink container (10).

8. An inker in accordance with claim 7, wherein said interior space (40) of said ink container (10) is in communication with a pressure medium line through which said interior space (40) formed between said ink container (10) and said cover element (20) can be filled with said gas.

9. An inker in accordance with claim 1, wherein upper surfaces of an ink container frame of said ink container (10) and of one of the printing block (12) and said printing block holder (22) are located in approximately a same plane, and in said second extreme position of said cover element (20), a cover element frame on an open side of said cover element (20) facing said ink container (10) is located approximately in said same plane of said upper surfaces of said ink container frame.

10. An inker in accordance with claim 1, wherein a cover element frame of said cover element (20) is formed by sealing bodies (30, 32, 34, 36).

11. An inker in accordance with claim 1, wherein said cover element (20) forms sealing bodies (30, 32, 34, 36) and said sealing bodies (30, 32, 34, 36) are in pressure contact with an ink container frame of said ink container (10).

12. An inker in accordance with claim 1, wherein said cover element (20) forms sealing bodies (30, 32, 34, 36) and said sealing bodies (30, 32, 34, 36) are of an elastically deformable material.

13. An inker in accordance with claim 1, wherein an interior space (40) of said cover element (20) is filled with a gas which displaces ambient air and does not react with ink in said ink container (10).

14. An inker in accordance with claim 1, wherein an interior space (40) of said cover element (20) of said ink container (10) is in communication with a pressure medium line through which said interior space (40) formed between said ink container (10) and said cover element (20) can be filled with said gas.

* * * * *